US011702819B2

(12) United States Patent
Vanderlinde et al.

(10) Patent No.: US 11,702,819 B2
(45) Date of Patent: Jul. 18, 2023

(54) ELECTROHYDRAULIC IMPLEMENT CONTROL SYSTEM AND METHOD

(71) Applicant: DEERE & COMPANY, Moline, IL (US)

(72) Inventors: Todd M. Vanderlinde, Dubuque, IA (US); John R. Mahrenholz, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 805 days.

(21) Appl. No.: 16/693,529

(22) Filed: Nov. 25, 2019

(65) Prior Publication Data

US 2021/0156122 A1 May 27, 2021

(51) Int. Cl.

| | |
|---|---|
| ***E02F 3/28*** | (2006.01) |
| ***E02F 9/26*** | (2006.01) |
| ***E02F 3/34*** | (2006.01) |
| *E02F 5/14* | (2006.01) |
| *E02F 3/43* | (2006.01) |
| *E02F 9/20* | (2006.01) |

(52) U.S. Cl.
CPC ..... *E02F 9/265* (2013.01); *E02F 3/3414* (2013.01); *E02F 3/432* (2013.01); *E02F 3/433* (2013.01); *E02F 5/145* (2013.01); *E02F 9/2029* (2013.01)

(58) Field of Classification Search
CPC ..... E02F 3/432; E02F 3/433; E02F 3/3414; E02F 5/145; E02F 9/265; E02F 9/2029
USPC ..... 701/50
See application file for complete search history.

(56) References Cited

U.S. PATENT DOCUMENTS 5,797,310 A 8/1998 Casey et al.
7,555,898 B2 7/2009 Wada
(Continued)

FOREIGN PATENT DOCUMENTS

EP 3951069 A1 * 2/2022 ..... E02F 3/32

OTHER PUBLICATIONS

M. Immonen et al., "Fusion of 4D Point Clouds From a 2D Profilometer and a 3D Lidar on an Excavator," in IEEE Sensors Journal, vol. 21, No. 15, pp. 17200-17206, 1 Aug. 1, 2021, doi: 10.1109/JSEN.2021.3078301. (Year: 2021).*
(Continued)

*Primary Examiner* — Cuong H Nguyen
(74) *Attorney, Agent, or Firm* — Taft Stettinius & Hollister LLP; Stephen F. Rost

(57) ABSTRACT

A work machine includes a mainframe, a boom moveable relative to the mainframe, a work implement coupled to and moveable relative to the boom. The work machine further includes a work-implement operator control configured to transmit a signal indicative of a work-implement movement command, a boom operator control configured to transmit a signal indicative of a boom movement command, and a boom sensor configured to detect a movement of the boom and transmit a signal indicative of the detected movement of the boom. The work implement further includes a controller
(Continued)

configured to receive signals from the work-implement operator control, the boom operator control, and the boom sensor. The controller is further configured transmit a signal to cause movement the work implement relative to the boom based on the detected movement of the boom and the work-implement movement command.

12 Claims, 4 Drawing Sheets

(56) References Cited

U.S. PATENT DOCUMENTS

| | | | | |
|---|---|---|---|---|
| 9,340,955 | B2 | 5/2016 | Shimazu et al. | |
| 10,017,919 | B2 * | 7/2018 | Nomura | G01C 21/04 |
| 10,106,952 | B2 * | 10/2018 | Iwamura | E02F 9/264 |
| 10,214,877 | B2 * | 2/2019 | Yamada | E02F 9/262 |
| 10,385,541 | B2 | 8/2019 | Dean | |
| 11,293,168 | B2 * | 4/2022 | Kenkel | E02F 9/2228 |
| 2012/0130599 | A1 * | 5/2012 | Faivre | E02F 9/265 701/50 |
| 2012/0330515 | A1 * | 12/2012 | Numazaki | F15B 11/048 701/50 |
| 2015/0275469 | A1 * | 10/2015 | Fredrickson | E02F 9/265 701/50 |
| 2016/0108602 | A1 | 4/2016 | Singh et al. | |
| 2016/0153165 | A1 * | 6/2016 | Singh | E02F 3/433 701/50 |
| 2016/0251835 | A1 * | 9/2016 | Kitajima | E02F 3/3663 701/50 |
| 2019/0226175 | A1 * | 7/2019 | Mairet | E02F 3/422 |

OTHER PUBLICATIONS

H. Taketsugu, Y. Takashi, A. Junichi, I. Masaki and Y. Hiroaki, "Experimental land model of tele-operated underwater backhoe with AR technology," Proceedings of the 2004 International Symposium on Underwater Technology (IEEE Cat. No. 04EX869), 2004, pp. 339-344, doi: 10.1109/UT.2004.1405600. (Year: 2004).*

D. Das, P. Chowdhury, B. N. M. Truong and K. K. Ahn, "A novel energy recuperation system for hybrid excavator using hybrid actuator," 2015 15th International Conference on Control, Automation and Systems (ICCAS), 2015, pp. 1930-1935, doi: 10.1109/ICCAS.2015.7364681. (Year: 2015).*

Salih Korucu et al., Mini Excavator Design And Analysis; International Journal of Innovative Science and Research Technology; vol. 2, Issue 11, Nov. 2017. (Year: 2017).*

Padovani, D., Rundo, M., and Altare, G. (Mar. 6, 2020). "The Working Hydraulics of Valve-Controlled Mobile Machines: Classification and Review." ASME. J. Dyn. Sys., Meas., Control. Jul. 2020; 142(7): 070801. https://doi.org/10.1115/1.4046334 (Year:2020).*

German Search Report issued in application No. DE102020212648.8 dated Jul. 8, 2021 (10 pages).

* cited by examiner

ELECTROHYDRAULIC IMPLEMENT CONTROL SYSTEM AND METHOD

FIELD OF THE DISCLOSURE

The present disclosure relates to a construction or work machine, such as a skid steer loader or a compact track loader, and more particularly to control systems for adjusting a position of a work implement of the work machine.

BACKGROUND OF THE DISCLOSURE

Work machines, such as those in the agricultural, construction and forestry industries, perform a variety of operations. In some instances, the machines are provided with a work implement or tool to perform a desired function. The work implement or tool, such as a bucket, forklift, or grapple, is movably coupled to a frame of the machine by a mechanical lift arm or boom. The lift arm or boom is operably controlled by a machine operator using operator controls disposed in a cab of the machine.

In one instance, the machine may have a work implement operably connected to a boom which is rotatably coupled to a frame of the machine for upward and downward movement relative to the frame. In another instance, a boom is connected to the frame with two or more links. The operator of the machine adjusts the position of the boom as well as the position of the work implement to collect a material which can be located at a ground level or at other heights above ground level. Once the material is collected in the work implement, the material is moved to a desired location which can be at the ground level or at the other heights above ground level. The operator, in different embodiments of the work machine operably controls the work implement height and the work implement angle using one or more joysticks. In one embodiment, a boom joystick adjusts both a velocity and height of the boom and a work implement joystick adjusts both a velocity and level of the work implement.

There is a need to adjust the level of the work implement automatically so that the contents of the work implement do not spill, and there is a need to achieve this adjustment with a cost effective solution. Such systems are quite complex, however, due the presence of a large number of sensors which not only require maintenance but also require calibration. Such sensors may be expensive, and in some instances, prohibitively so. What is needed therefore is a work machine that maintains relatively the same level of performance, while reducing not only the number of sensors in some instance, but also reducing the level of complexity of the control system maintaining work implement location and position.

SUMMARY

In an illustrative embodiment of the present disclosure, a work machine includes: a mainframe; a boom moveable relative to the mainframe; a work implement coupled to and moveable relative to the boom; a work-implement operator control configured to transmit a signal indicative of a work-implement movement command; a boom operator control configured to transmit a signal indicative of a boom movement command; a boom sensor configured to detect a movement of the boom and transmit a signal indicative of the detected movement of the boom; a controller configured to (i) receive signals from the work-implement operator control and the boom sensor and (ii) transmit a signal to cause movement the work implement relative to the boom based on the detected movement of the boom and the work-implement movement command.

In some embodiments, the boom sensor is configured to detect a velocity of the boom and transmit a signal indicative of the detected velocity of the boom. In some embodiments, the controller includes a memory configured to store ratio data. The ratio data includes boom velocities and corresponding work implement velocities required to maintain the work implement at a constant angle relative to the mainframe during movement of the boom. The controller is configured to transmit a signal to cause movement the work implement at a specified work implement velocity based on the detected velocity of the boom and the work implement movement command.

The boom sensor is configured to detect a position of the boom relative to the mainframe and transmit a signal indicative of the detected position of the boom. In some embodiments, the ratio data includes, for each position of the boom, boom velocities and corresponding work implement velocities required to maintain the work implement at a constant angle relative to the mainframe during movement of the boom. The controller is configured to transmit a signal to cause movement the work implement at a specified work implement velocity based on the detected velocity of the boom, the detected position of the boom, and the work implement movement command.

In some embodiments, the memory is configured to store boom stop position data, the boom stop position data includes one or more stop positions of the boom beyond which the boom can move no further. The controller is configured to transmit a signal to stop movement of the work implement based on the boom stop position and the detected position of the boom.

In some embodiments, the boom sensor is configured to detect an upward or a downward direction of movement of the boom and transmit a signal indicative of the detected direction of movement. The ratio data includes, for each direction of movement of the boom, boom velocities and corresponding work implement velocities required to maintain the work implement at a constant angle relative to the mainframe during movement of the boom. The controller is configured to transmit a signal to cause movement the work implement at a specified work implement velocity based on the detected velocity of the boom, the detected position of the boom, the detected direction of movement of the boom, and the work implement movement command. In some embodiments, the ratio data for the upward direction of movement of the boom is different than the ratio data for the downward direction of movement of the boom.

In some embodiments, the work machine is devoid of a sensor configured to detect movement or position of the work implement. In some embodiments, the work machine includes a work implement sensor configured to detect at least one of movement and position of the work implement.

In another embodiment of the present disclosure, an open loop control system for a work machine is adapted for use with a mainframe, a boom moveable relative to the mainframe, and a work implement moveable relative to the boom. The open loop control system includes: a boom operator control configured to transmit of signal indicative of a boom movement command; a boom sensor configured to (i) detect a velocity of the boom and (ii) transmit a signal indicative of the detected velocity of the boom; a work-implement actuator coupled to the work implement and configured to move the work implement relative to the boom; a controller configured to (i) receive a signal from the boom sensor, and (ii) transmit a signal to the work-implement actuator causing the work-implement actuator to extend or retract at a specified velocity to maintain the work implement at a constant angle relative to the mainframe during movement of the boom, wherein the signal transmitted to the work-implement actuator is based on the detected velocity of the boom.

In some embodiments, the boom sensor is configured to (i) detect a position of the boom relative to the mainframe and (ii) transmit a signal indicative of the detected position of the boom. The signal transmitted to the work-implement actuator from the controller is based on the detected velocity of the boom and the detected position of the boom.

In some embodiments, the controller includes a memory configured to store boom stop position data. The boom stop position data includes one or more stop positions of the boom beyond which the boom can move no further. The signal transmitted to the work-implement actuator is based on the stop position of the boom, the detected position of the boom, and the detected velocity of the boom.

In some embodiments, the boom sensor is configured to (i) detect a direction movement of the boom relative to the mainframe and (ii) transmit a signal indicative of the detected direction of movement of the boom. The signal transmitted to the work-implement actuator from the controller is based on the detected velocity of the boom and the detected direction of movement of the boom.

In another embodiment of the present disclosure, the work implement includes a method of moving a work implement coupled to the boom of a work machine. The method includes: detecting, with a sensor coupled to the boom, a velocity and a position of the boom; transmitting a signal indicative of the detected velocity and the detected position of the boom; transmitting, from a controller in communication with the sensor, a signal to move the work-implement relative to the boom at a specified velocity of the work implement based on the detected velocity of the boom and the detected position of the boom.

In some embodiments, the method includes detecting, with the sensor coupled to the boom, a direction of movement of the boom. The specified velocity of the work implement is further based on the detected direction of movement of the boom. In some embodiments, the method includes accessing a stop position of the boom from a memory included in the controller. The stop position of the boom is a position beyond which the boom can move no further. In some embodiments, the method includes transmitting, from the controller, a signal to stop movement of the work implement based on the detected position of the boom and the stop position of the boom.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
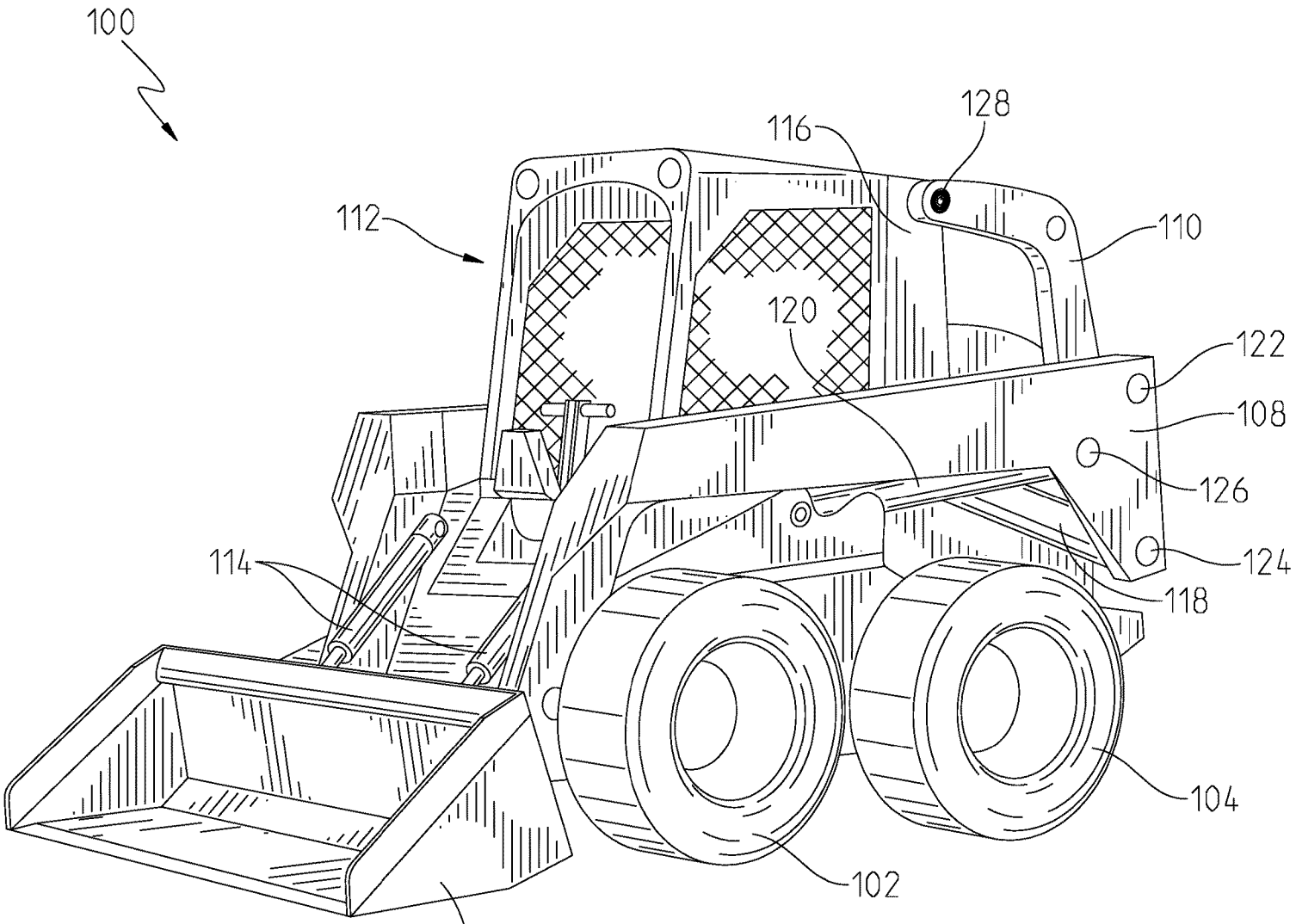
FIG. 1 is a side perspective view of a skid steer loader work machine.

Referring to FIG. 1, an exemplary embodiment of a work machine, such as a skid steer loader 100, is shown. This disclosure is not intended to be limited to a skid steer loader, however, but rather may include any agricultural, construction, or forestry machinery. The present disclosure is also directed to front end loader having a ground engaging traction member, including wheels or tracks, and lift or boom arms having pivot locations located behind or in front of an operator of the vehicle. The skid steer loader 100 includes a ground-engaging mechanism for moving along the ground. In FIG. 1, the ground-engaging mechanism includes a pair of front wheels 102 and a pair of rear wheels 104. In another aspect, such as a compact track loader, the ground-engaging mechanism can be a drive track disposed on each side of the machine. In a conventional skid steer loader, the operator manipulates machine controls from inside a cab 112 to drive the wheels on the right or left side of the machine 100 at different speeds to thereby steer the machine 100 in a conventional manner.

The machine 100 can be further provided with a work implement or tool for performing a desired operation. In FIG. 1, the skid steer 100 includes an implement 106, also referred to more specifically as a bucket or a loader bucket at times, for collecting material therein and transporting said material to a desired location. The work implement 106 can be pivotally coupled to a forward portion of a pair of boom arms 108 positioned on each side of the machine 100. Collectively, the pair of boom arms 108 may be referred to as the boom 108. A pair of work implement tilt hydraulic actuators 114 (otherwise known as work-implement actuators 114) can extend between the work implement 106 and the boom arms 108 for controlling the tilted orientation of the work implement 106 with respect to the boom arms 108. Each work-implement actuator 114 can include a cylinder rod that actuates back and forth within a cylinder in response to a change in hydraulic pressure. By actuating the tilt hydraulic actuators 114, the operator can tilt the work implement 106 for dumping material therefrom. The term "boom arm" and "boom" are used interchangeably throughout.

In FIG. 1, the loader work implement 106 is shown at a minimum height. To raise the work implement 106, each of a pair of boom arms of the boom 108 is connected to an upper link 110 at a first location 122 and a lower link 118 at a second location 124. The upper link 110 and lower link 118 are also attached to a main frame 116 of the skid steer 100 at opposite ends of where each connects to the boom arm 108. A boom hydraulic actuator 120 is pivotally secured at one end to the main frame 116 and coupled to the boom arm 108 at an opposite end thereof. The hydraulic actuator 120 connects to the boom arm 108 at a third location 126. The first location 122, second location 124, and third location 126 are each approximately equidistantly spaced from one another. In other embodiments, the spacing between the first location 122, the second location 124, and the third location 126 are spaced apart and arranged in other configurations.

On each side of the machine, a boom arm of the boom 108 is pivotally coupled to the upper link 110, lower link 118, and boom hydraulic actuator 120. As the boom hydraulic actuator 120 actuates between an extended position and a retracted position, the work implement 106 is correspondingly raised and lower with respect to the main frame 116. The work implement 106 is rotatably coupled to the end of the boom 108 which is fixedly coupled to the work implement actuators 114. Extension and retraction of the work-implement actuators 114 adjusts the position of the work implement 106 with respect to the boom 108.

The machine 100 further includes a boom sensor 128 configured to measure the velocity of the boom 108. In the illustrative embodiment, the boom sensor 128 is an arc angle position sensor, which is also configured to measure position and direction of movement of the boom 108 with respect to the mainframe 116 of the work machine 100. As illustratively shown in FIG. 1, the boom sensor 128 is positioned on a pin joint of the upper link 110 of the boom 108. As used herein, "movement" includes one or more of a velocity component and a direction of movement component. Thus, the boom sensor 128 is configured to detect movement and position of the boom 108, and more specifically, the boom sensor 128 is configured to detect a velocity, a position, and a direction of movement of the boom 108 relative to the mainframe 116. The boom sensor 128 is also configured to transmit a signal indicative of the velocity, the position, and/or the direction of movement of the boom 108 relative to the mainframe 116.

Figure 2:
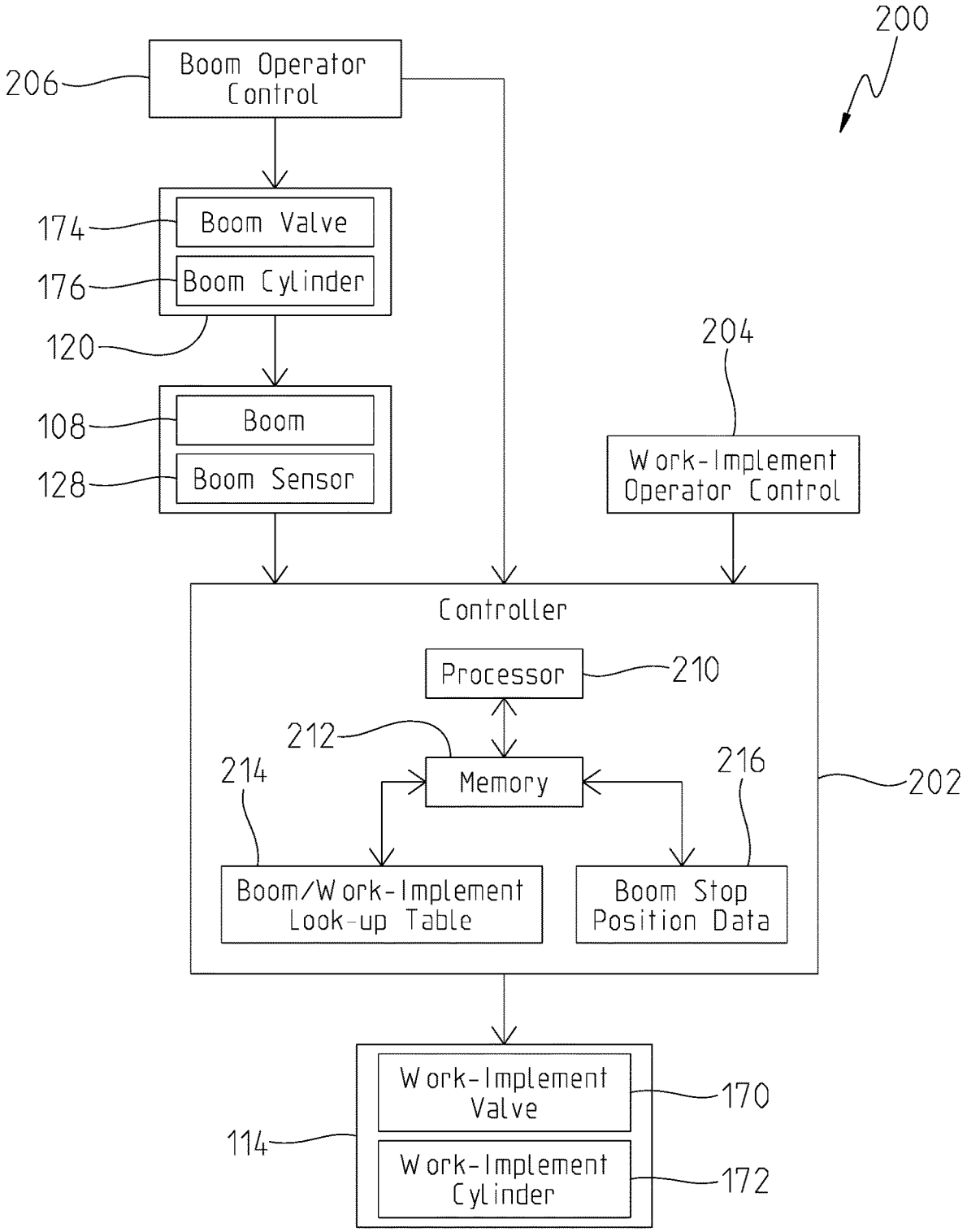
FIG. 2 is a block diagram of a control system for a work machine.

FIG. 2 illustrates one embodiment of a control system 200 adapted for use with the work machine 100. The control system 200 may be used for controlling the height and tight of the work implement 106. In some embodiments, the control system is an electrohydraulic control system 200 as will be described in greater detail below. The control system 200 includes one or more user controls located at a control panel located in the cab 112 of the work machine 100 for use by the operator. A controller 202 is located in or on the work machine 100 and is typically located within the cab 106.

A work-implement operator control 204, such as a joystick, is operatively connected to the controller 202 and provides a control signal or command signal that varies based on the location of the joystick as adjusted by the operator. In the illustrative embodiment, this may be referred to as a work-implement movement command or a signal indicative of a work-implement movement command. The work-implement operator control 204 adjusts the position of the work implement 106 with respect to the boom 108. A boom operator control 206, such as a joystick, is also operatively connected to the controller 202 and provides a control signal or command signal that varies with based on the location of the joystick as adjusted by the operator. In the illustrative embodiment, this may be referred to as a boom movement command or a signal indicative of a boom movement command. The boom operator control 206 adjusts the position of the boom 108. While the operator controls 204 and 206 are often a joystick, each of the controls in different embodiments includes a button, a switch, a lever, a knob, or other means for sending an electrical signal to the controller 202. Additional controls may be provided for the machine operator to communicate with the controller 202.

The controller 202, in one or more embodiments, includes a processor 210 operatively connected to a memory 212. In still other embodiments, the controller 202 is a distributed controller having separate individual controllers distributed at different locations on the vehicle. In addition, while the controller is generally hardwired by electrical wiring or cabling to related components, in other embodiments the controller includes a wireless transmitter and/or receiver to communicate with a controlled or sensing component or device which either provides information to the controller or transmits controller information to controlled devices.

The controller, in different embodiments, includes a computer, computer system, or other programmable devices. In other embodiments, the controller 202 includes one or more processors 210 (e.g. microprocessors), and an associated memory 212, which can be internal to the processor or external to the processor. The memory 212 can include random access memory (RAM) devices comprising the memory storage of the controller 202, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to the controller 202. The mass storage device can include a cache or other dataspace which can include databases. Memory storage, in other embodiments, is located in the "cloud", where the memory is located at a distant location which provides the stored information wirelessly to the controller 202.

The controller 202 executes or otherwise relies upon computer software applications, components, programs, objects, modules, or data structures, etc. Software routines resident in the included memory of the controller 202 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in the memory 212 and other storage devices which execute the instructions resident in the memory 212, which are responsive to other instructions generated by the system, or which are provided at a user interface operated by the user. The processor 210 is configured to execute the stored program instructions as well as to access data stored in one or more data tables including one or more boom-to-bucket velocity ratio lookup tables 214.

The controller 202 is operatively connected to the work-implement actuators 114 and the boom actuators 120. In one embodiment, as illustrated in FIG. 2, the work-implement actuator 114 includes a work-implement valve 170 operatively connected to the controller 202 to receive control signals generated by the processor 210. In one embodiment, the work implement valve 170 is a 2-way, solenoid-operated directional spool valve. The work implement valve 170 is operatively connected to a work implement cylinder 172, which in one embodiment is a two way hydraulic cylinder. The signal transmitted from the controller 202 to the work implement valve 170 directs the cylinder 172 to extend or retract, to cause movement of the work implement either as a dumping movement or a curling movement depending on the directional input provided by the operator through the work-implement operator control 204. A source of hydraulic fluid for the cylinders is not shown.

The boom actuator 120 includes an boom valve 174 operatively connected to the controller 202 to receive control signals generated by the processor 210. In one embodiment, the boom valve 174 is a 2-way, solenoid-operated directional spool valve. The boom valve 174 is operatively connected to a boom cylinder 176, which in one embodiment is a two way hydraulic cylinder. The signal transmitted from the controller 202 to the arm valve 174 directs the cylinder 176 to move the boom 108 in the upward or downward direction relative to the mainframe 116, which in turn raises or lowers the work implement 106 depending on the directional input provided by the operator through the boom operator control 206.

FIG. 2 illustrates a single valve operatively connected to a single cylinder for each of the work-implement actuator 114 and boom actuator 120; however in practice, the work-implement actuator 114 includes a single valve hydraulically connected to two cylinders. Similarly, the boom actuator 120 includes a single valve hydraulically connected to two cylinders. Each of the valves 170, 174 is configured to controllably adjust the position of each connected cylinder. The present disclosure, however, is not limited to the described arrangement of actuators, and other configurations are contemplated so long as they are capable of moving the work implement 106 and the boom 108 as described.

As shown in FIG. 2, the boom 108 also includes the boom sensor 128, which is electrically coupled to the controller 202. The controller 202 is configured to receive signals from the work-implement operator control 204, the boom operator control 206, and the boom sensor 128. As described above, the signal transmitted from the work-implement operator control 204 is indicative of a work-implement movement command. The signal transmitted from the boom operator control 206 is indicative of a boom movement command. Additionally, the signal transmitted from the boom sensor 128 is indicative of a detected movement of the boom 108. This detected movement may include the velocity and the direction of movement of the boom 108. The controller 202 may transmit a signal to the work implement actuator 114 to cause movement the work implement 106 relative to the boom 108 based on the detected movement of the boom 108 and the work-implement movement command.

In some embodiments, the boom sensor 128 is configured to detect a position of the boom 108. The signal transmitted from the boom sensor 128 may be indicative of the detected position of the boom 108 in addition to the detected movement of the boom 108. The controller 202 may transmit a signal to the work-implement actuator 114 to cause movement the work implement 106 relative to the boom 108 based on the detected movement of the boom 108, the work-implement movement command, and the detected position of the boom 108.

As described above, the memory 212 is configured to store one or more boom-to-bucket velocity ratio lookup tables 214. The tables 214 include ratio data including values of boom velocities and corresponding values of work implement velocities that are required to maintain the work implement 106 at a constant angle relative to the mainframe 116 during movement of the boom 108. In other words, the ratio data indicates, for each boom velocity, the work-implement velocity required to maintain the work implement 106 level relative to mainframe 116.

In the illustrative embodiment, the ratio between boom velocity and corresponding work implement velocity required to maintain a level work implement 106 varies with the position of the boom 108. As such, the boom-to-bucket velocity ratio lookup table 214 includes, for each position of the boom 108, boom velocities and corresponding work implement velocities required to maintain the work implement 108 at a constant angle relative to the mainframe 116 during movement of the boom 108. Similarly, the controller 202 is configured to transmit a signal to the work-implement actuator 114 to cause movement the work implement 106 at a specified work implement velocity based on the detected velocity of the boom 108, the detected position of the boom 108, and the work-implement movement command.

In the illustrative embodiment, the ratio between boom velocity and corresponding work implement velocity required to maintain a level work implement 106 during movement of the boom 108 varies depending on which direction the boom 108 is moving relative to the mainframe 116. As such, the boom-to-bucket velocity ratio lookup table 214 includes, for each direction of movement of the boom 108, boom velocities and corresponding work implement velocities required to maintain the work implement 108 at a constant angle relative to the mainframe 116. The boom-to-bucket velocity ratio data for the upward direction of movement of the boom 108 is different than the corresponding ratio data for the downward direction of movement of the boom 108. The controller 202 is configured to transmit a signal to the work-implement actuator 114 to cause movement the work implement 106 at a specified work implement velocity based on the detected velocity of the boom 108, the detected direction of movement of the boom 108, and the work-implement movement command.

In some embodiments, the memory 212 is configured to store boom stop position data 216. As used herein, "boom stop position" means a position beyond which the boom 108 can no longer move. In some instances, the boom stop position may be a physical limitation on the range of motion of the work machine 100, and in other instances, the boom stop position may be a selectable position limitation that is different (often more limited) than the range of motion physically allowed by the work machine 100. The selectable position limitation may be selected or predetermined based on the type of implement 106 included with the work machine 100. Additionally, the selectable position limitation may be set by an operator or other user of the work machine 100 based on a particular application for the work machine 100, such as the height of a dump location or the weight of the payload contents in the work implement 106. As such, the boom stop position data 216 includes one or more stop positions of the boom 108 beyond which the boom 108 can move no further.

In the illustrative embodiment, the controller 200 is configured to transmit a signal to stop or cease movement of the work implement 106 based on the boom stop position data 216 and the detected position of the boom 108. In other words, when the position of the boom 108 approaches the boom stop position, the controller 202 transmits a signal to the work-implement actuator 114 to cease movement of the work implement 106 prior to the boom 108 reaching the boom stop position. This feature of the work machine 100 prevents the work implement 108 from experiencing overtravel as a result of a delay between sensor recognition and hydraulic actuation associated with the electrohydraulic control system 200.

It should be appreciated that in some embodiments, the specified work implement velocity may be based on any one or more of: (i) the work-implement operator control command, (ii) the detected velocity of the boom 108, (iii) the detected position of the boom 108, (iv) the detected direction of movement of the boom 108, (v) and the stop position of the boom 108.

It should also be appreciated that in some embodiments, the work implement 100 is absent any sensor configured to detect movement or position of the work-implement; such sensors may be referred to as work-implement sensors. Work implement sensors may be expensive and introduce additional complexity to the system; therefore, it may be desirable to have a system devoid of all work-implement sensors. A work machine that is devoid of work-implement sensors may still change the position of the work-implement relative to the boom; however, no feedback can be provided regarding the resulting position of the work implement. A work machine having a control system devoid of work-implement sensors may be referred to as an open loop control system, meaning that the control system does not receive feedback indicative of work implement position or movement.

Figure 3:
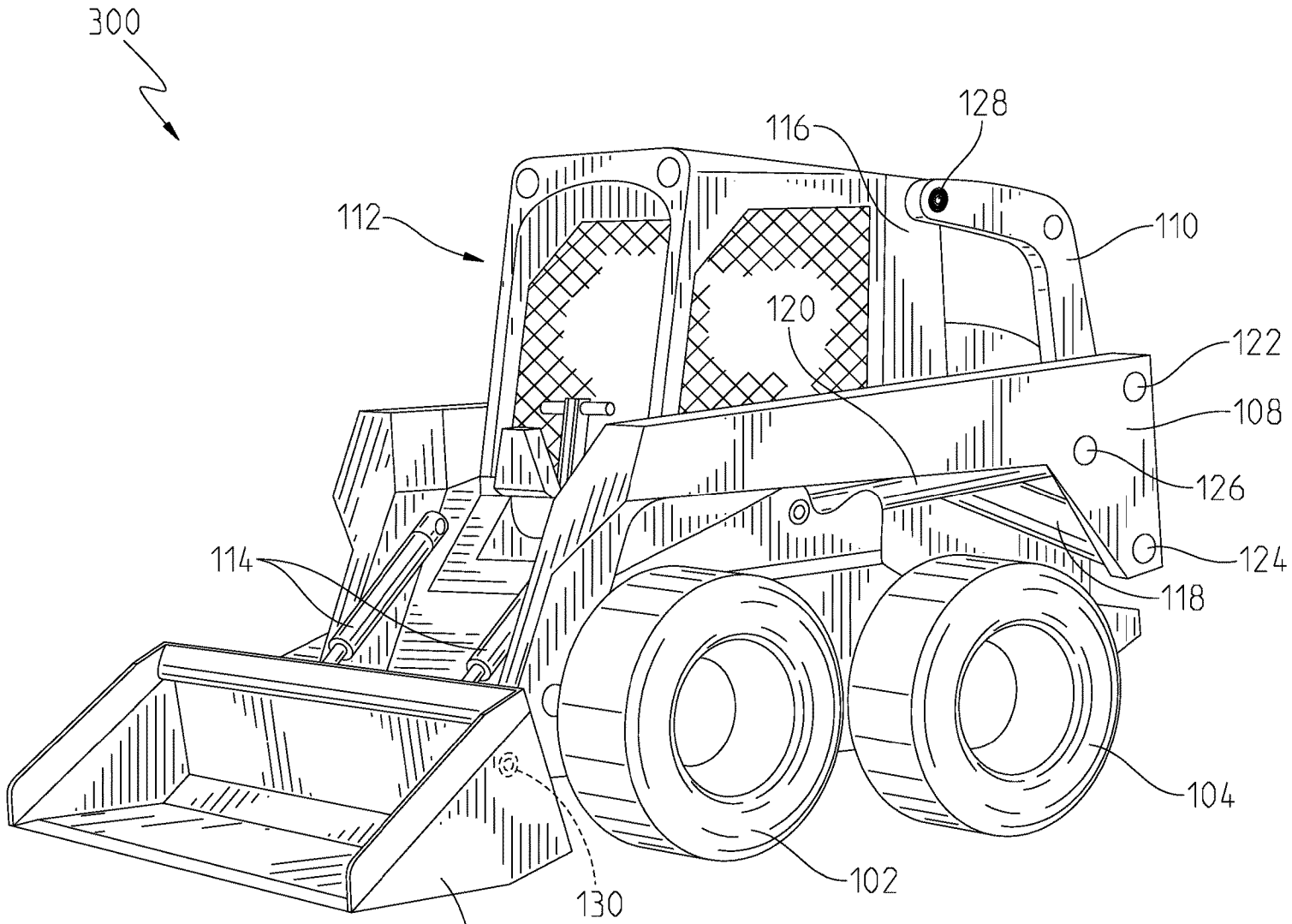
FIG. 3 is a side perspective view of another skid steer loader work machine devoid of a work implement sensor.
Figure 4:
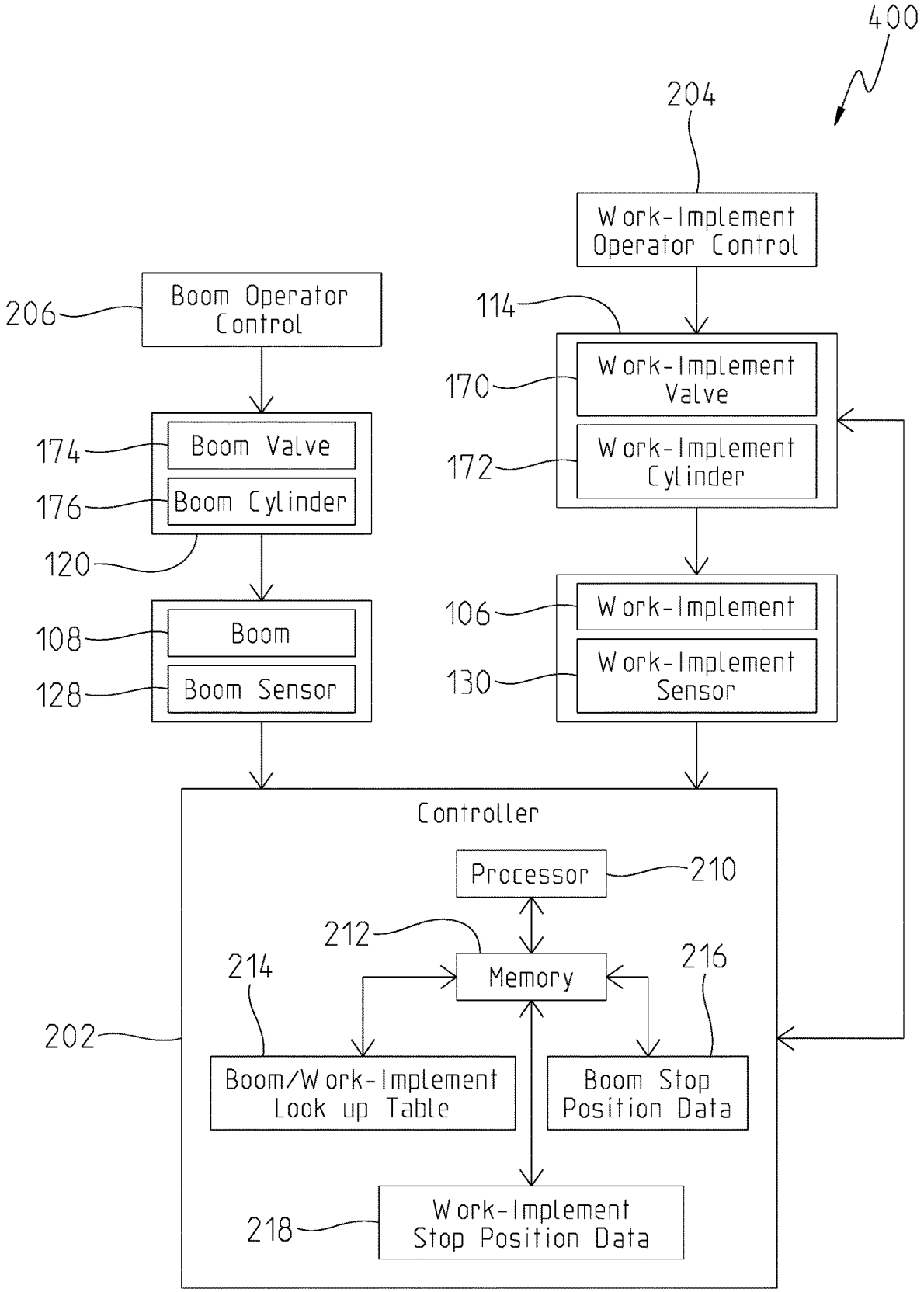
FIG. 4 is a block diagram of another control system for a work machine.

In some embodiments, the work machine may include a closed loop control system, such as the closed loop control system 400 shown in FIG. 4. A closed loop control system is capable of providing and receiving feedback indicative of work implement position or movement. In some embodiments of the closed loop control system 400, a work implement 300 may include a work implement sensor 130, as shown in FIG. 3. It should be appreciated that the features of the work implement 300 are identical to the features of the work implement 100, unless otherwise noted. The same reference numbers are therefore used to represent identical features included in both the work machine 100 and the work machine 300.

As shown in FIG. 3, the implement sensor 130 is configured to measure the velocity of the work implement 106. In the illustrative embodiment, the work implement sensor 130 is an arc angle position sensor, which is also configured to measure position and direction of movement of the work implement 106. As illustratively shown in FIG. 3, the work implement sensor 130 is positioned on a pin joint shown in phantom coupling the work-implement 106 to the boom 108. It should be appreciated that the work-implement sensor 130 may be positioned anywhere on or away from the work machine 100, so long as the work-implement sensor 130 is capable of detecting position and/or movement of the work implement 106 as described herein.

As used herein, "movement" may include a velocity and a direction of movement. Thus, the work-implement sensor 130 is configured to detect movement and position of the work implement 106 and more specifically, the work implement sensor 130 is configured to detect a velocity, a position, and a direction of movement of the work implement 106. The work-implement sensor 130 is also configured to transmit a signal indicative of the velocity, the position, and/or the direction of movement of the work-implement 130. In some embodiments, the controller 202 is configured to receive the signal transmitted from the work-implement sensor 130 and compare the position and movement of the work implement 106 to a desired, selected, or commanded position and/or movement of the work implement 106.

In some embodiments, the memory 212 is configured to store work implement stop position data 218. As used herein, "work implement stop position" means a position beyond which the work implement 106 can no longer move. In some instances, the work implement stop position may be a physical limitation on the range of motion of the work machine 100, and in other instances the work implement stop position may be a selectable position limitation that is different (often more limited) than the range of motion physically allowed by the work machine 100. The selectable position limitation may be selected or predetermined based on the type of implement 106 included with the work machine 100. Additionally, the selectable position limitation may be set by an operator or other user of the work machine 100 based on a particular application for the work machine 100, such as the height of a dump location or the weight of the payload contents in the work implement 106. As such, the work implement stop position data 218 includes one or more stop positions of the boom 108 beyond which the boom 108 can move no further.

In the illustrative embodiment, the controller 202 is configured to transmit a signal to stop or cease movement of the work implement 106 based on the work implement stop position data 218 and the detected position of the work implement 106. In other words, when the position of the work implement 106 approaches the work implement stop position, the controller 202 transmits a signal to the work-implement actuator 114 to cease movement of the work implement 106 prior to the work implement 106 reaching the work implement stop position. This feature of the work machine 100 prevents the work implement 106 from experiencing over-travel as a result of a delay between sensor recognition and hydraulic actuation associated with the electrohydraulic control system 200.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A work machine comprising:

a mainframe;

a boom moveable relative to the mainframe;

a work implement coupled to and moveable relative to the boom;

a work-implement operator control configured to transmit one or more signals indicative of a work-implement movement command;

a boom operator control configured to transmit one or more signals indicative of a boom movement command;

a boom sensor configured to detect a velocity and direction of upward or downward movement of the boom relative to the mainframe and transmit one or more signals indicative of the detected velocity and direction of upward or downward movement of the boom relative to the mainframe; and a controller configured to (i) receive one or more signals from the work-implement operator control and the boom sensor and (ii) transmit one or more signals to cause movement the work implement relative to the boom based on the detected velocity, direction of upward or downward movement of the boom relative to the main frame, and the work-implement movement command;

wherein the controller includes a memory configured to store ratio data that includes boom velocities and corresponding work implement velocities required to maintain the work implement at a constant angle relative to the mainframe during movement of the boom;

wherein the ratio data includes, for an upward direction of movement of the boom and a downward direction of movement of the boom, boom velocities and corresponding work implement velocities required to maintain the work implement at a constant angle relative to the mainframe during movement of the boom; and wherein the ratio data for the upward direction of movement of the boom is different than the ratio data for the downward direction of movement of the boom.

2. A method of moving a work implement coupled to the boom of a work machine comprising:

receiving, with a controller, an indication of a direction of upward or downward movement for the boom relative to a mainframe of the work machine to which the boom is coupled;

detecting, with a sensor coupled to the boom, a velocity and a position of the boom;

determining a desired work implement velocity based on ratio data that includes boom velocities and corresponding work implement velocities required to maintain the work implement at a constant angle relative to the mainframe during movement of the boom;

wherein the ratio data includes, for an upward direction of movement of the boom and a downward direction of movement of the boom, boom velocities and corresponding work implement velocities required to maintain the work implement at a constant angle relative to the mainframe during movement of the boom; and wherein the ratio data for the upward direction of movement of the boom is different than the ratio data for the downward direction of movement of the boom;

transmitting, from a controller in communication with the sensor, one or more signals causing movement of the work-implement relative to the boom at the desired work implement velocity, which is based on the detected velocity of the boom, the detected position of the boom, and the direction of upward or downward movement for the boom relative to the mainframe.

3. The method of claim 2, further comprising:

accessing a stop position of the boom from a memory included in the controller, wherein the stop position of the boom is a position beyond which the boom can move no further; and transmitting, from the controller, one or more signals to stop movement of the work implement based on the detected position of the boom and the stop position of the boom.

4. The method of moving a work implement of claim 2, further comprising:

determining, with the controller, the work implement velocity without use of a detected position or a detected velocity of the work implement.

5. An open loop control system for a work machine including a mainframe, a boom moveable relative to the mainframe, and a work implement moveable relative to the boom, the open loop control system comprising:

a boom operator control configured to transmit one or more signals indicative of a boom movement command including a direction of upward or downward movement of the boom relative to the mainframe;

a boom sensor configured to (i) detect a velocity of the boom and (ii) transmit one or more signals indicative of the detected velocity of the boom;

a work-implement actuator coupled to the work implement and configured to move the work implement relative to the boom; and a controller configured to (i) receive one or more signals from the boom sensor, and (ii) transmit one or more signals to the work-implement actuator causing the work-implement actuator to extend or retract at a velocity that maintains the work implement at a constant angle relative to the mainframe during movement of the boom, wherein the one or more signals that the controller is configured to transmit are based on the detected velocity of the boom and the direction of upward or downward movement of the boom relative to the mainframe;

wherein the controller includes a memory configured to store ratio data that includes boom velocities and corresponding work implement velocities required to maintain the work implement at a constant angle relative to the mainframe during movement of the boom;

wherein the ratio data includes, for an upward direction of movement of the boom and a downward direction of movement of the boom, boom velocities and corresponding work implement velocities required to maintain the work implement at a constant angle relative to the mainframe during movement of the boom; and wherein the ratio data for the upward direction of movement of the boom is different than the ratio data for the downward direction of movement of the boom.

6. The work machine of claim 1, wherein:

the memory is configured to store boom stop position data, the boom stop position data includes one or more stop positions of the boom beyond which the boom can move no further, and the controller is configured to transmit a signal to stop movement of the work implement based on the boom stop position and the detected position of the boom.

7. The open loop control system of claim 5, wherein the boom sensor is configured to (i) detect a position of the boom relative to the mainframe and (ii) transmit one or more signals indicative of the detected position of the boom.

8. The open loop control system of claim 7, wherein the one or more signals that the controller is configured to transmit to the work-implement actuator are based on the detected velocity of the boom, the direction of movement of the boom, and the detected position of the boom.

9. The open loop control system of claim 8, wherein:

the memory is configured to store boom stop position data, the boom stop position data includes one or more stop positions of the boom beyond which the boom can move no further, and the one or more signals transmitted to the work-implement actuator are based on the stop position of the boom, the detected position of the boom, the direction movement of the boom, and the detected velocity of the boom.

10. The work machine of claim 1, wherein the work machine is devoid of a sensor configured to detect movement or position of the work implement.

11. The work machine of claim 1, further comprising a work implement sensor configured to detect at least one of movement and position of the work implement.

12. The open loop control system of claim 5, wherein the open loop control system is devoid of a sensor configured to detect movement or position of the work implement.

* * * * *